US005520117A

United States Patent [19]

Teichmann et al.

[11] Patent Number: 5,520,117

[45] Date of Patent: May 28, 1996

[54] PENDULUM SUSPENSION FOR TRACTION VEHICLE MOTOR-TRANSMISSION UNIT

[75] Inventors: Martin Teichmann; Hugo Rackl, both of Graz; Gerhard Neurohr, Nestelbach; Herbert Haas, Graz; Hans Hodl, Graz; Andreas Haigermoser, Graz, all of Austria

[73] Assignee: SGP Verkenrstechnik Gessellschaft m.b.H., Vienna, Austria

[21] Appl. No.: 386,524

[22] Filed: Feb. 6, 1995

Related U.S. Application Data

[63] Continuation-in-part of Ser. No. 124,024, Sep. 21, 1993, abandoned.

[30] Foreign Application Priority Data

Sep. 21, 1992 [AU] Australia ..... 1876/92

[51] Int. Cl.[6] ..... B61C 17/00

[52] U.S. Cl. ..... 105/139; 105/133

[58] Field of Search ..... 105/133, 138, 105/139

[56] References Cited

U.S. PATENT DOCUMENTS

| | | | |
|---|---|---|---|
| 668,924 | 2/1901 | McElroy | 105/139 |
| 3,468,389 | 9/1969 | Nelson | 105/139 |
| 4,170,945 | 10/1979 | Kayserling | 105/133 |
| 4,787,318 | 11/1988 | Vogel | 105/136 |

FOREIGN PATENT DOCUMENTS

| | | | |
|---|---|---|---|
| 0235644 | 9/1987 | European Pat. Off. . | |
| 0444016 | 8/1991 | European Pat. Off. . | |
| 355717 | 11/1905 | France . | |
| 2426600 | 12/1979 | France . | |
| 2650035 | 5/1978 | Germany . | |
| 2657447 | 6/1978 | Germany | 105/139 |
| 2822991 | 11/1979 | Germany | 105/138 |
| 141013 | 2/1993 | Germany . | |
| 338856 | 7/1959 | Switzerland . | |
| 1089405 | 2/1963 | Switzerland . | |
| 1676887 | 9/1991 | U.S.S.R. | 105/138 |
| 2024124 | 1/1980 | United Kingdom . | |

*Primary Examiner*—Robert J. Oberleitner
*Assistant Examiner*—S. Joseph Morano
*Attorney, Agent, or Firm*—Jacobson, Price, Holman & Stern

[57] ABSTRACT

A traction vehicle, in particular railway traction vehicle, comprising a bogey chassis mounted on wheel axles, a vehicle chassis spring-mounted on the bogey chassis and at least one motor-transmission unit mounted underneath the vehicle chassis and within the bogey chassis close to the wheel axle driven by the motor-transmission unit. The motor-transmission unit is suspended from the bogey chassis by a pendulum suspension close to the set of wheels in the bogey chassis. The motor-transmission unit is also suspended in the vehicle by a pendulum suspension. The motor transmission unit is provided with a pair of connecting rods in which either or both are connected to the bogey chassis or the vehicle chassis. The connecting rods are arranged with one rod parallel to the longitudinal axis of the vehicle and the other rod being either parallel to or angularly related to the longitudinal axis of the vehicle.

24 Claims, 2 Drawing Sheets

PENDULUM SUSPENSION FOR TRACTION VEHICLE MOTOR-TRANSMISSION UNIT

CROSS REFERENCE TO RELATED APPLICATION

This application is a continuation-in-part of application U.S. Ser. No. 08/124,024 filed Sep. 21, 1993, now abandoned for Traction Vehicle, in Particular Railway Traction Vehicle.

BACKGROUND OF THE INVENTION AND PRIOR ART

The invention relates to a railway traction vehicle comprising a bogey chassis mounted on wheel axles including a vehicle chassis spring-mounted on the bogey chassis and at least one motor-transmission unit drivingly connected to a wheel axle and mounted underneath the vehicle chassis and within the bogey chassis close to the wheel axle. The motor transmission unit is suspended from pendulum suspension means close to the wheel axle in the bogey chassis as well as being suspended in the vehicle chassis.

Such a construction of a power bogey in which the motor-transmission unit is suspended at three points is known for example from DE-PS 28 22 992. In that case the unit is mounted close to the wheel set from pendulum suspension means and close to the pivoting pin of the bogey, as a pivoting point, in the locomotive box in order to uncouple the mass of the motor-transmission unit from the bogey chassis and at the same time to reduce relative movements between the transmission and the set of wheels to a minimum. This results in the major part of the mass of the unit being secondarily sprung together with the locomotive box and in the pivoting point in the carriage box being fixed close to the high axle of the bogey.

However, the known linkage of the motor to the locomotive box causes large relative displacements between the transmission and the wheel set shaft. Moreover, due to this type of suspension it is necessary to place the pivoting point of the motor-transmission unit close to the bogey high axle regardless of conflicting requirements, e.g. with a view to riding stability, since otherwise the afore-said movements would become too large for currently employed transmission couplings.

In a bogey construction according to DE-OS 26 50 035 the suspension of the motor-transmission unit proceeds by way of pendulum suspension means all of which are fitted to the vehicle chassis. Moreover and in addition to a single connecting rod parallel to the longitudinal axis of the vehicle a rather complicated and heavy servo-mechanism is provided. In a bogey construction according to DE-AS 10 89 405 the motor is suspended by way of pendulum suspension means and is guided along in fixed relationship to the bogey in all horizontal directions by an arrangement of three connecting rods and without the possibility to pivot in relation to the bogey.

CH-PS 338 856 finally discloses an apparatus for the lateral support of as drive motor of a locomotive. The purpose of this apparatus composed of a V-shaped bracket is to relieve stresses applied to the cross bar of the bogey.

GENERAL DESCRIPTION OF THE INVENTION

The object of the present invention is a traction vehicle of the afore-said type comprising a suspension for the motor-transmission unit which uncouples the mass thereof from the bogey chassis, keeps relative movements between the transmission and the set of wheels to a minimum and yet at the same time permits greater freedom regarding the arrangement of the pivoting point of the motor-transmission unit.

This object is attained according to the invention in that the suspension of the motor-transmission unit is effected on the vehicle chassis in a manner known per se by way of a pendulum suspension means and the unit is connected to the vehicle chassis and/or the bogey chassis by way of two connecting rods. The suspension by way of the pendulum suspension means, in conjunction with the provision of a spring shock absorber element between the motor-transmission unit and the bogey chassis, brings about the desired uncoupling, the pivoting point of the unit being determined by the two connecting rods and can in principle be provided at any desired position by appropriate orientation of the connecting rods. In this manner the pivoting point can be brought into whatever position is most advantageous, be it in relation to stability conditions for the travelling vehicle, for attaining the least possible relative movements between the unit and the axle of the wheel set etc.

According to a further feature both connecting rods can be arranged parallel in relation to the vertical/longitudinal central plane of the vehicle or of the bogey chassis or one of the connecting rods can be in angular relation to the longitudinal central plane of the vehicle.

Advantageously one of the connecting rods is linked to the vehicle chassis, such connecting rod being positioned preferably parallel to the vehicle longitudinal axis. In that case the motor-transmission unit is longitudinally uncoupled by the bogey which offers the advantage that the mass of the unit in the event of an over-run impact need not be absorbed by the bogey.

If according to a further feature of the invention both connecting rods are linked to the vehicle chassis, the centre of gyration is fixed in relation to the former and all moments of force derived from the motor-transmission unit can be absorbed by the vehicle chassis without stressing the bogey.

By way of contrast, in an alternative embodiment in which both connecting rods are linked to the bogey chassis, a gyratory pole fixed in relation to the bogey results which offers the advantage that the relative movements between the wheel set and the transmission can be kept very small.

Finally it is advantageous to provide between the motor-transmission unit and the bogey a combined spring-shock-absorbing element.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF SPECIFIC EMBODIMENTS

Figure 1:
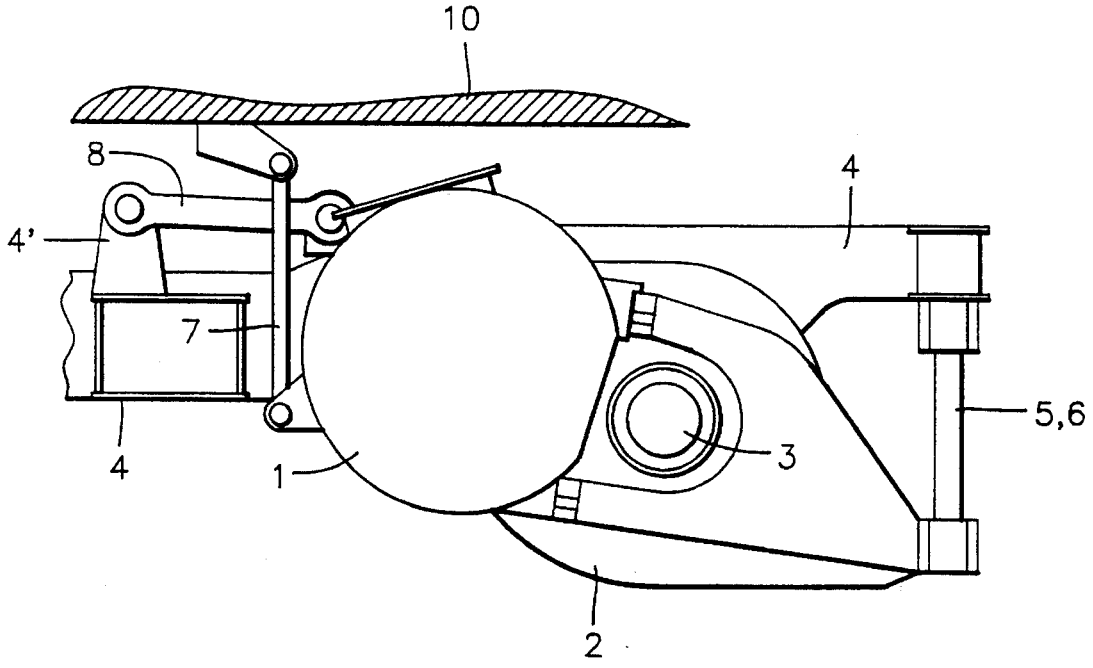
FIG. 1 is a schematic side elevational view of one half of a power bogey according to the invention in which a connecting rod is connected to the bogey chassis.

The drive motor 1 with its transmission 2 flanged rigidly thereto is arranged parallel close to the wheel set axle 3 driven thereby and having its running wheels 3' on the inside of the bogey chassis 4. Close to the wheel set axle 3, the unit 1,2 is suspended by way of two pendulum suspension means 5 from the bogey chassis 4. On the motor side the suspension of the unit 1,2 is brought about by a pendulum suspension means 7 in the locomotive box or vehicle chassis 10.

Figure 1A:
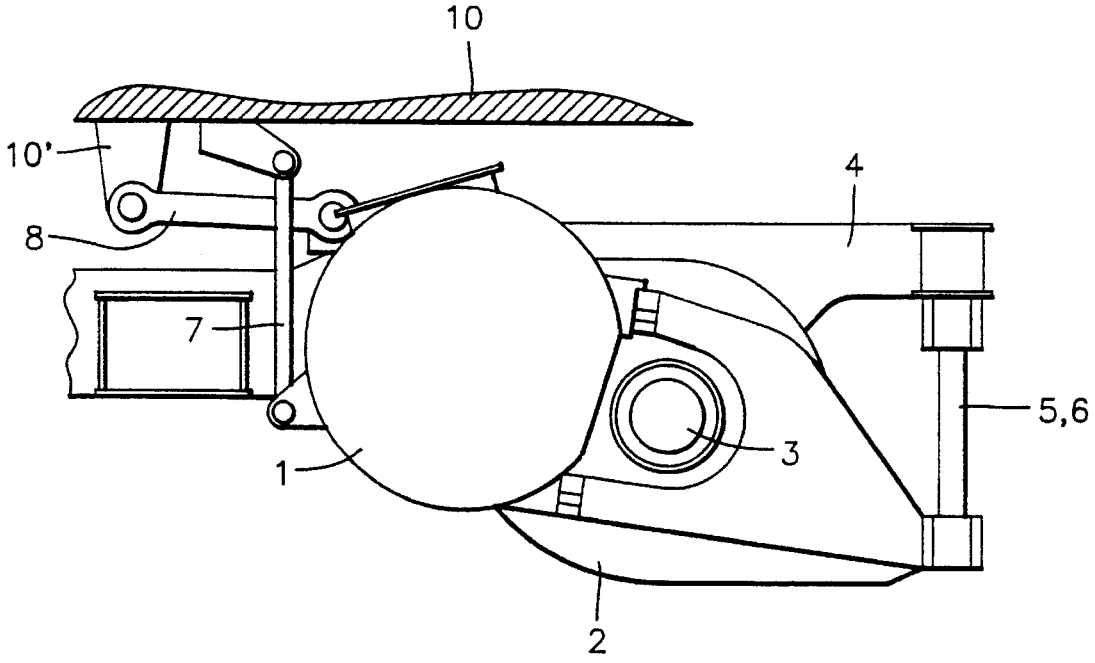
FIG. 1*a* is a side view similar to FIG. 1 illustrating a connecting rod connected to the vehicle chassis.
Figure 2:
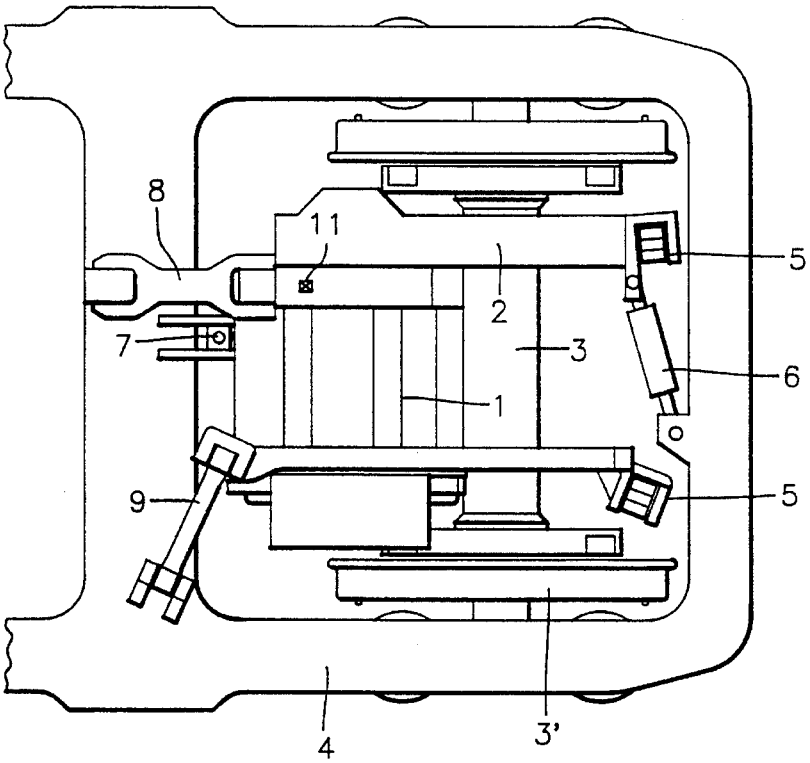
FIG. 2 is a plan view of the half bogey according to FIG. 1 in which the connecting rods are angularly related.
Figure 3:
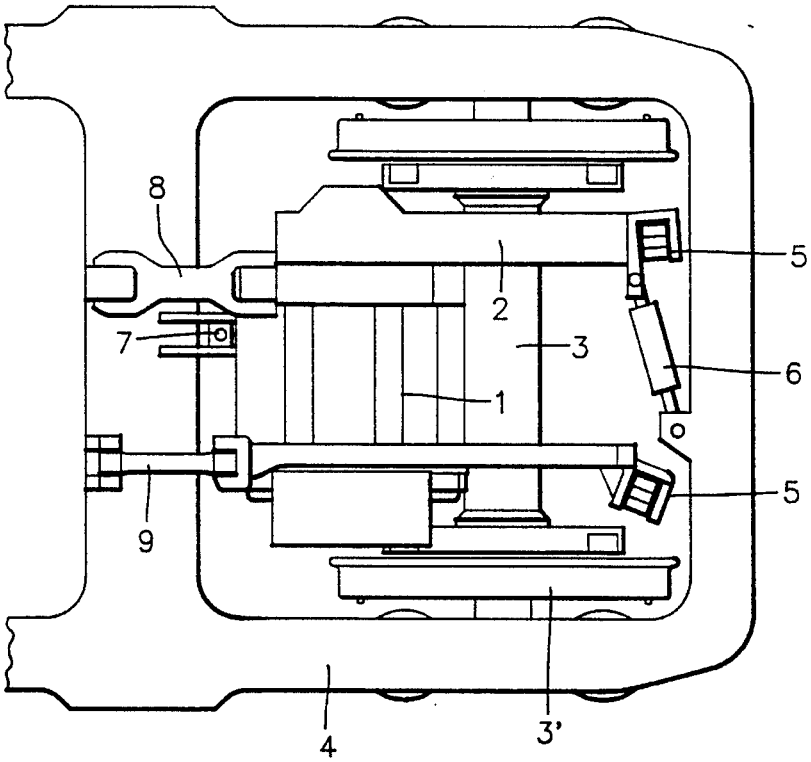
FIG. 3 is a similar plan view, in which, however, the two connecting rods are arranged parallel to each other.

The position of the unit 1,2 in longitudinal direction is defined by the connecting rods 8 and 9 connected to the motor 1. The connecting rods 8 and 9 absorb the longitudinal forces arising during acceleration or decelerations in spite of the lightest possible and simplest construction of the connecting rod 8 and 9 and their mounting. As illustrated in FIG. 1, connecting rod 8 is connected to bogey chassis 4 by bracket 4'. In FIG. 1*a*, connecting rod 8 is connected to the vehicle chassis 10 by bracket 10'. FIG. 2 illustrates both connecting rods 8,9 connected to the bogey chassis with the rods being angular in relation to each other. FIG. 3 illustrates both connecting rods 8 and 9 being parallel to each other and parallel to the central vertical plane of the vehicle. Either or both connecting rods are connected to either the bogey chassis 4 or the vehicle chassis 10.

The intersection of the lines of action of the two connecting rods 8,9 represents an instantaneous centre of rotation for the motor 1 and the transmission 2 respectively the unit formed thereby. The pivoting pole, being the intersection of the lines of action which are defined by the axes of the connecting rods 8,9 can be brought into almost any desired point, for example, as illustrated into the center of gravity 11 of the unit 1,2 as illustrated in FIG. 2.

For attaining the desired elasticity and damping characteristics between the motor-transmission unit 1,2 and the bogey chassis 4 a combined spring-shock-absorbing element 6 is provided, the task of which can obviously with equal effect also be performed by two or more separate elements.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A traction vehicle, comprising at least one bogey chassis, each bogey chassis mounted on at least one wheel axle, a vehicle chassis mounted on each bogey chassis, and at least one motor-transmission unit for driving said at least one wheel axle mounted underneath the vehicle chassis and within one of the bogey chassis between said wheel axle and the center of the bogey chassis, and said unit being suspended by pendulum suspension means from the bogey chassis on the side of said driven wheel axle and from the vehicle chassis on the other side, said unit being guided in the longitudinal direction of the bogey chassis by means of two connecting rods linked at one end to said unit, at least one of said connecting rods being linked at its other end to the bogey chassis, at least one of the connecting rods being parallel to the longitudinal vertical center plane through the vehicle or the bogey chassis.

2. A traction vehicle according to claim 1, wherein the traction vehicle is a railway traction vehicle.

3. A traction vehicle according to claim 1, wherein both of the connecting rods are parallel to the longitudinal vertical center plane through the vehicle or the bogey chassis.

4. A traction vehicle according to claim 1, wherein both of the connecting rods are directly linked at their other end to the bogey chassis.

5. A traction vehicle according to claim 1, wherein at least one of the connecting rods is arranged horizontally.

6. A traction vehicle according to claim 5, wherein both connecting rods are arranged horizontally.

7. A traction vehicle according to claim 1, wherein a spring-shock absorbing element is connected between the unit and the bogey chassis.

8. A traction vehicle comprising at least one bogey chassis, each bogey chassis mounted on at least one wheel axle, a vehicle chassis mounted on each bogey chassis, and at least one motor-transmission unit for driving said at least one wheel axle mounted underneath the vehicle chassis and within one of the bogey chassis between said wheel axle and the center of the bogey chassis, and said unit being suspended by pendulum suspension means from the bogey chassis on the side of said driven wheel axle and from the vehicle chassis on the other side, said unit being guided in the longitudinal direction of the bogey chassis by means of two connecting rods linked at one end to said unit, at least one of said connecting rods being linked at its other end to the vehicle chassis, at least one of the connecting rods being parallel to the longitudinal vertical center plane through the vehicle or the bogey chassis.

9. A traction vehicle according to claim 8, wherein the traction vehicle is a railway traction vehicle.

10. A traction vehicle according to claim 8, wherein both of the connecting rods are parallel to the longitudinal vertical center plane through the vehicle or the bogey chassis.

11. A traction vehicle according to claim 8, wherein both of the connecting rods are directly linked at their other end to the vehicle chassis.

12. A traction vehicle according to claim 8, wherein at least one of the connecting rods is arranged horizontally.

13. A traction vehicle according to claim 12, wherein both connecting rods are arranged horizontally.

14. A traction vehicle according to claim 8, wherein a spring-shock absorbing element is connected between the unit and the bogey chassis.

15. A traction vehicle, comprising at least one bogey chassis, each bogey chassis mounted on at least one wheel axle, a vehicle chassis mounted on each bogey chassis, and at least one motor-transmission unit for driving said at least one wheel axle mounted underneath the vehicle chassis and within one of the bogey chassis between said wheel axle and the center of the bogey chassis, and said unit being suspended by pendulum suspension means from the bogey chassis on the side of said driven wheel axle and from the vehicle chassis on the other side, said unit being guided in the longitudinal direction of the bogey chassis by means of two connecting rods linked at one end to said unit and at their other end to the vehicle chassis or the bogey chassis, the axes of the connecting rods intersecting, whereby a center of rotation for the unit is defined.

16. A traction vehicle according to claim 15, wherein the traction vehicle is a railway traction vehicle.

17. A traction vehicle according to claim 15, wherein a spring-shock absorbing element is connected between the unit and the bogey chassis.

18. A traction vehicle according to claim 15, wherein one of the connecting rods is arranged parallel to the longitudinal vertical center plane through the vehicle or bogey chassis.

19. A traction vehicle according to claim 15, wherein the intersection point of the axes of the two connecting rods and thereby the center of rotation for the unit coincides with the center of gravity of the unit.

20. A traction vehicle according to claim 15, wherein at least one of the connecting rods is arranged horizontally.

21. A traction vehicle according to claim 20, wherein both connecting rods are arranged horizontally.

22. A traction vehicle according to claim 15, wherein both connecting rods are linked directly to the vehicle chassis.

23. A traction vehicle according to claim 15, wherein both connecting rods are linked directly to the bogey chassis.

24. A traction vehicle according to claim 15, wherein one connecting rod is linked directly to the vehicle chassis and the other one is linked directly to the bogey chassis.

* * * * *